United States Patent [19]

Gianforcaro, II et al.

[11] Patent Number: 5,074,512

[45] Date of Patent: Dec. 24, 1991

[54] MONITOR-MOUNTABLE ADJUSTABLE ASSEMBLY FOR SUPPORTING A SHEET OF DRAWING-EXHIBIT, USING A DRAWING-MOUSE OR DIGITAL TABLET CUSOR

[76] Inventors: George F. Gianforcaro, II; Anthony Gianforcaro, both of 7 Franklin Rd., Mendham, N.J. 07945

[21] Appl. No.: 445,422

[22] Filed: Dec. 4, 1989

[51] Int. Cl.[5] ..... B41J 11/02

[52] U.S. Cl. ..... 248/442.2; 248/279; 248/918

[58] Field of Search ..... 248/442.2, 918, 278, 248/279, 285, 286, 287; 400/718

[56] References Cited

U.S. PATENT DOCUMENTS

| | | | |
|---|---|---|---|
| 1,041,002 | 10/1912 | Bergh | 248/278 |
| 1,098,999 | 6/1914 | Walker | 248/442.2 X |
| 1,700,629 | 1/1929 | Douglas | 400/718 X |
| 2,520,884 | 8/1950 | Laube | 248/278 X |
| 2,739,569 | 3/1956 | Brazee | 400/718 |
| 4,475,705 | 10/1984 | Henneberg et al. | 248/447.2 |
| 4,619,429 | 10/1986 | Mazza | 248/447.2 |
| 4,632,471 | 12/1986 | Visnapuu | 248/442.2 X |
| 4,693,443 | 9/1987 | Drain | 248/447.1 |
| 4,767,093 | 8/1988 | Jones | 248/205.3 X |
| 4,869,565 | 9/1989 | Bachman | 248/918 X |

*Primary Examiner*—David M. Purol

*Attorney, Agent, or Firm*—William T. Hough

[57] ABSTRACT

A computer monitor drawing-exhibit sheet-mounting and adjusting assembly adapted for viewing the drawing exhibit while drawing with a computer drawing-mouse or digital tablet-cusor, the assembly in a preferred embodiment thereof including adjustable vise mechanisms allowing adjustably alternatively increasing or diminishing horizontal arm(s) and depth arm(s) thereof to correspond to height and width dimensions of any of diverse computer monitors, including upper arm(s), opposite-end downwardly-extending arms, and extending from the downwardly-extending arms there being distal arms extendable beneath the computer monitor on which the assembly is being mounted, and including a pivotable and extendable drawing-exhibit support arm having a sheet-attaching mechanism for intermittently attaching and detaching a drawing-exhibit sheet.

35 Claims, 3 Drawing Sheets

MONITOR-MOUNTABLE ADJUSTABLE ASSEMBLY FOR SUPPORTING A SHEET OF DRAWING-EXHIBIT, USING A DRAWING-MOUSE OR DIGITAL TABLET CUSOR

THE SPECIFICATION

This invention is directed to the conventional technology of drawing with a computer mouse or digital tablet-cusor while viewing a drawing exhibit and a computer monitor screen.

THE PRIOR ART

Nothing was found in the prior art relevant to the coordinated use of a computer drawing-mouse or digital tablet-cusor with a drawing-exhibit concurrently while comparing to a monitor screen. Prior to the present invention, there has existed Henneberg et al U.S. Pat. No. 4,475,705 issued Oct. 9, 1984, to a document holder of finite shape and dimensions with a support arm thereof shaped to fit over the top and opposing side upper portions of a display terminal, for the reading thereof when keyboard transcribed by use of a keyboard, the patent also disclosing prior art document-holding desk stands. Mazza U.S. Pat. No. 4,619,429 discloses an alternate related document holding assembly having a top intermediate portion of finite length corresponding to the width of the monitor, together with securing straps that circumscribingly extend downwardly from the top intermediate portion, onwardly to beneath the monitor, and onwardly back upwardly to the top intermediate portions, fastened securely thereby to the monitor as a mounting of the top intermediate portions from which document holders extend laterally from opposite ends of the top intermediate portion; alternate mechanism of securing the downwardly-extending portion is disclosed. The bore-containing coupling blocks 62 are disclosed as a mechanism for adjusting lateral distance-positioning of the document-holding wing panels 58 and 60. Drain U.S. Pat. No. 4,693,443 discloses a document holder fixedly/permanently mountable by screw or adhesively to a lateral face of a monitor.

BACKGROUND

Prior to the present invention, draftsmen and/or architects and/or engineers utilizing the latest technology of utilizing a computer drawing-mouse or digital tablet-cusor while concurrently comparing blueprints or the like on a monitor screen to and in comparison with exhibit-drawings and in thee concurrent use of the mouse or digital tablet-cusor to superimpose data viewed from the drawing-exhibit onto the computer screen blueprint, have been faced with the heretofore difficulties and/or hardship and unsolved problem of inadequate ways of simultaneously handling and/or temporarily mounting/supporting all of the papers while using the computer mouse or digital tablet-cusro. Normally and often the exhibit-papers and/or documents are of large and varying width and length sizes and shapes not readily adaptable to conventional document holders. As well, frequently and normally such exhibit-papers and/or documents are in the nature of non-rigid paper not readily supportable. Paper weights and/or tacks have been less than satisfactory alternatives and conventional document holders conclusively are not functionally capable of adequately doing the job. Because of the necessity of manually handling the mouse or digital tablet-cusor when making drawing and/or notation changes to the blueprint image on the computer screen, together with visually making reference to particular points on the drawing-exhibit in comparison to the image viewed on the computer screen, the person's mere two hands while maintaining his concentrated attention to the task of making needed entries onto the computer monitor's memory as viewed on the screen, has proven to be extremely difficult and awkward and not readily possible devoid of excessive strain, consumption of excessive time and experiencing of distractions from optimal concentration and attention to the crucial matters being attended to. Moreover, in arriving at the present invention, it was noted that no easy solution existed for mounting, suspending or hanging a document support on computer monitors, it being additionally discovered that notoreously when moving from one computer monitor to another either within the same or different desks and/or offices, the width and height dimensions of word processor and/or computer monitors vary considerably from one monitor to another. That fact accounts for prior art devices heretofore having been rigidly mounted onto monitors by screws or adhesive or the like, as above-noted.

THE OBJECTS

Objects of the invention include the overcoming and/or avoiding of one or more of the above-noted problems, difficulties, disadvantages and the like, together with achieving an assembly embodying solutions directed thereto to enhance simplicity and efficiency in use of a computer drawing-mouse or digital tablet-cusor with regard to altering image(s) on a computer monitor and view on the screen thereof.

More particularly, another object is to obtain for coordinated use with a computer drawing-mouse or digital tablet-cusor, a novel assembly adapted for supporting large sheets or sheets of varying sizes and shapes, by adjustable support structure adjustable to fit any of alternate computer monitors of varying height and width dimensions.

Another object is to obtain one or more preceding objects, together with adjustable mechanism for alternate positioning of suspended drawing-sheet(s) facilitating the use of a drawing mouse or digital tablet-cusor while viewing the drawing-sheet(s).

Another object, for coordinated use with a computer drawing-mouse or digital tablet-cusor, is to obtain a drawing-exhibit holder assembly adapted for use by simple and easy adjustment for the mounting on and/or removal from any of a variety of alternate computer monitors, by persons of minimal mechanical skill.

Another object is to obtain a mounting assembly of simple and small structure for the mounting of drawing-exhibits in the coordinated use thereof with a computer drawing-mouse or digital table-cusor.

Another object is to obtain a mounting assembly of small and compactable structure and parts enabling easy assembly and disassembly thereof in the coordinated use thereof for the mounting of a drawing-exhibit for concurrent use with a computer drawing-mouse or digital tablet-cusor.

Other objects become apparent from the preceding and following disclosure.

BROAD DESCRIPTION OF THE INVENTION

Broadly the invention may be described a a computer monitor drawing-exhibit sheet-mounting and adjusting device for use with a computer mouse or digital tablet-cusor, including a drawing-exhibit support mechanism, and an adjustable vise mechanism. The drawing-exhibit support mechanism is such as to support and suspend one or more drawing-exhibit sheet(s) that are required to be viewed and studied while concurrently observing a computer monitor screen and concurrently drawing with a mouse to add to or supplement the screen image. The adjustable vise mechanism is such that the drawing-exhibit support mechanism that is mounted on the adjustable vise mechanism, is mountable by the adjustable vise mechanism onto any one of computer monitors of varying size dimensions by the mere clamping it onto opposite substantially upright sides of the computer monitor.

In a preferred embodiment, the adjustable vise mechanism includes an adjusting mechanism by which the adjustable vise mechanism is adjustably mountable of the drawing-exhibit support mechanism intermittently such that the drawing-exhibit support mechanism may be positioned alternately forwardly or rearwardly along a substantially horizontal plane whereby supported, suspended exhibit-sheet(s) are viewable in alternate viewing positions, when the adjusting vise mechanism is mounted on a computer monitor. For this preferred embodiment, more preferably the drawing-exhibit support mechanism includes a substantially horizontally extending rod structure from which the drawing-exhibit(s) is/are suspendable and supportable. In an alternate more preferred embodiment, there is included a sheet downwardly-suspending mechanism adapted to intermittently substantially downwardly suspend one or more drawing-exhibit sheet(s) therefrom, when the vise mechanism is mounted on a computer structure suitably for the viewing of suspended drawing-exhibit sheet(s). In the horizontal rod-containing embodiment, more preferably the horizontally extending rod is axially adjustable substantially horizontally relative to the adjusting mechanism, when the adjustable vise mechanism is mounted on a computer monitor. In this embodiment, of the drawing exhibit support mechanism and the adjustable vise mechanism, one thereof is mounted pivotally on the other at a preascertained (predetermined) pivot location. This enables the horizontally extending rod structure to be pivotably laterally adjustable around the preascertained pivot location, when the adjustable vise mechanism is mounted on a computer monitor.

In another preferred embodiment, the prior noted embodiment having the sheet downwardly suspending mechanism includes the above-noted pivot mounted arrangement of the drawing exhibit support mechanism and the adjustable vise mechanism, one mounted pivotally on the other making possible the lateral pivotal adjustment of the horizontally extending rod. In this embodiment, the adjustable vise mechanism includes a support structure having laterally spaced-apart opposite first and second side portions thereof. The first side portion has a downwardly extending first clamping structure that is adapted to be pressed against a first substantially upright side of a computer monitor. A second side portion has a downwardly extending second clamping structure that is adapted to be pressed against a second substantially upright side spaced from and opposite the first substantially upright side such that a computer monitor is securable between the first and second clamping structures. The adjustable vise mechanism provides for at-least one of the first and second clamping structures to be intermittently adjustably and lockably alternately movable optionally toward and away from a remaining one of the first and second clamping structures, when the adjustable vise mechanism is mounted on a computer monitor. In a more preferred embodiment of the preceding preferred embodiment, at least one of the first and second clamping structures includes a first upper portion and a first downwardly-extending intermittently adjustable bottom clamp having a first clamp horizontal portion thereof extending toward a remaining other one of the first and second clamping structures. The first downwardly-extending portion is adapted to be intermittently locked at optionally different levels of downward extension. Thereby the first clamp horizontal portion is alternately movable upwardly toward and downwardly away from the upper portion such that a computer monitor is claspable between the first clamp horizontal portion and the first upper portion. In a still more preferred embodiment thereof, likewise the remaining other one of the first and second clamping structures includes a second upper portion and a second downwardly-extending intermittently adjustable bottom clamp having a second clamp horizontal portion thereof extending toward a remaining other one of the first and second clamping structures, and the second downwardly-extending intermittently adjustable bottom clamp is adapted to be intermittently locked at optionally different levels of downward extension such that thereby the second clamp horizontal portion is alternately movable upwardly toward and downwardly away from the upper portion such that a computer monitor is claspable between the second horizontal portion and the second upper portion. In a more preferred embodiment thereof, as noted-above for another embodiment, the horizontally extending rod structure is axially adjustable horizontally relative to the adjusting mechanism, when the adjustable vise mechanism is mounted on a computer monitor.

In other preferred embodiments, the above-noted preferred embodiment of the included support structure with first and second side portion and their respective first and second clamping structures and functions thereof, are a preferred embodiment of the broad invention above described as the drawing-exhibit support mechanism mounted on the adjustable vise mechanism, and the various above-recited preferred embodiments thereof. Additionally this embodiment more preferably for at least one, and more preferably on both of the first and second clamping structures, includes a first adjustably screwable clamp screwably alternately advanceable and retractable laterally away, for alternate pressing against a first upright side of a computer monitor, and away from that upright side, to mount onto or alternately release the adjustable vise mechanism from a mounting state on a computer monitor, when using the adjustable vise mechanism in mounting on a computer monitor. In these latter embodiments, there is provided the prior noted preferred variation of which the support structure and its first and second upper portions horizontally positioned, but additionally the adjustable clamping mechanism including a securable mechanism adapted to intermittently securably mount one of the first and second upper portions to a remaining other one thereof such that when the first and second upper portions are mounted one on the other, a first one thereof is positioned above one of the substantially first upright side walls of a computer monitor and a remaining other second one thereof is positioned above another second substantially upright side wall spaced-apart from and opposite the one side wall, when the adjustable clamping mechanism is mounted on a computer monitor. In a further preferred embodiment, the first and second upper portions extend axially in opposite directions between the first and second substantially upright walls, when the adjustable clamping mechanism is mounted on a computer monitor.

In a alternate embodiment of the prior embodiment having the first adjustably screwable clamp screwably alternately advanceable and retractable, the support structure includes first and second upper portions and an intermediate portion between the first and second upper portions positioned substantially along a horizontal plane when the adjustable clamping mechanism mounted on a computer monitor; the intermediate portion has spaced-apart opposite first and second intermediate portion ends. In this embodiment, the adjustable clamping mechanism includes first and second securable mechanisms for intermittently securably mounting one of the first and second upper portions to one of the first and second intermediate portion ends and for intermittently securably mounting a remaining other one of the first and second upper portions to a remaining other one of the first and second upper portions. Thereby, when the first and second upper portions are mounted on the first and second intermediate portion ends, a first one of the first and second upper portions is positioned above one of a substantially first upright side wall of a computer monitor and a remaining other second one of the first and second upper portion is positioned above another second substantially upright side wall spaced-apart from and opposite the one, when the adjustable clamping mechanism is mounted on a computer monitor. This embodiment, in other more preferred embodiments thereof, includes the above-noted preferred embodiment of the drawing-exhibit support means including a substantially extending rod structure, as well as other more preferred embodiments of that prior preferred embodiment.

Likewise, the above-noted more preferred embodiment of the first and second upper portions extending axially in opposite direction between the first and second substantially upright walls when the adjustable clamping mechanism is mounted on a computer monitor, has other more preferred embodiments corresponding to all other above-noted preferred embodiments previously described.

The invention may be better understood by making reference to the accompanying Figures illustrating typical alternate and/or preferred embodiments.

THE FIGURES

FIGS. 1 through 5 diagrammatically illustrate typical alternate embodiments of the invention above-described.

FIG. 1 diagrammatically illustrates a typical novel drawing-exhibit sheet-mounting adjustable device utilizing scewably-adjustable vise clamping structures, diagrammatically illustrated in a front view thereof as it would appear when mounted on a computer or word processor monitor that is shown in phantom, and likewise the supportable sheet of drawing-exhibit being also shown in phantom as supported from the horizontally swing-adjustable laterally-extending pivotably-mounted supporting rod, the sheet being suspended by typically spring clamps thereof.

FIG. 2 diagrammatically illustrates another typical alternate novel drawing-exhibit sheet-mounting adjustable device of different shape and construction, also utilizing the vise-principle together with a scewably-adjustable vise clamping structure in opposition to a spaced-away rigid immovable opposing other arm-structure thereof, diagrammatically illustrating the device in front view thereof, as it would appear when mounted on a computer or word processor monitor that is shown in phantom, and likewise the supportable sheet of drawing-exhibit being also shown in phantom as supported from the horizontally swing-hinge adjustable laterally-extending drawing-exhibit sheet supporting rod with the sheet being suspended typically by typically spring clamps thereof.

FIG. 3 diagrammatically illustrates another typical alternate novel drawing-exhibit sheet-mounting adjustable device of different shape and construction, utilizing also telescoping vise-structures in conjunction with the vise-principle together for adjusting and locking in position the adjustable arm with a vise-like arm in opposing relationship to a spaced-away rigid immovable opposing other arm-structure thereof, diagrammatically illustrating the device in front view thereof, as it would appear when mounted on a computer or word processor monitor that is shown in phantom, the drawing-exhibit sheet supporting rod being shown merely in-part, which supporting arm is illustrated to be hinged as in the FIG. 2 embodiment, but may optionally be of the telescoping type shown in FIGS. 1 and 2.

FIG. 4 diagrammatically illustrates another typical alternate novel drawing-exhibit sheet-mounting adjustable device of different shape and construction, as a variation in the shape and construction of the device of FIG. 3, the FIG. 4 embodiment utilizing a telescoping structure in conjunction with the vise-principle together for adjusting and locking in position the adjustable telescoping arm with a vise-like arm in opposing relationship to a spaced-away rigid immovable opposing other arm-structure thereof, diagrammatically illustrating the device in front view thereof, as it would appear when mounted on a computer or word processor monitor that is shown in phantom, the drawing-exhibit sheet supporting rod being shown merely in-part as a telescoping rod of the type of FIG. 1.

FIG. 5 diagrammatically illustrates the most preferred embodiment of the invention, adjustably clampable in both vertical and horizontal planes, illustrating a typical novel drawing-exhibit sheet-mounting adjustable device utilizing scewably-adjustable vise clamping structure, diagrammatically illustrated in a front view thereof as it would appear when mounted on a computer or word processor monitor that is shown in phantom, and likewise the supportable sheet of drawing-exhibit being also shown in phantom as supported from and by the horizontally pivotally adjustable and laterally-extending supporting rod by typically spring clamps thereof.

FIG. 6 diagrammatically illustrates an elevation plan view of FIG. 1 as it would be viewed looking downwardly on the illustrated embodiment of FIG. 1.

FIG. 7 diagrammatically illustrates an elevation plan view of FIG. 2 as it would be viewed looking downwardly on the illustrated embodiment of FIG. 2.

FIG. 8 diagrammatically illustrates an elevation plan view of FIG. 3 as it would be viewed looking downwardly on the illustrated embodiment of FIG. 3.

FIG. 9 diagrammatically illustrates an elevation plan view of FIG. 4 as it would be viewed looking downwardly on the illustrated embodiment of FIG. 4.

FIG. 10 diagrammatically illustrates an elevation plan view of FIG. 5 as it would be viewed looking downwardly on the illustrated embodiment of FIG. 5.

DETAILED DESCRIPTION

Figure 1:
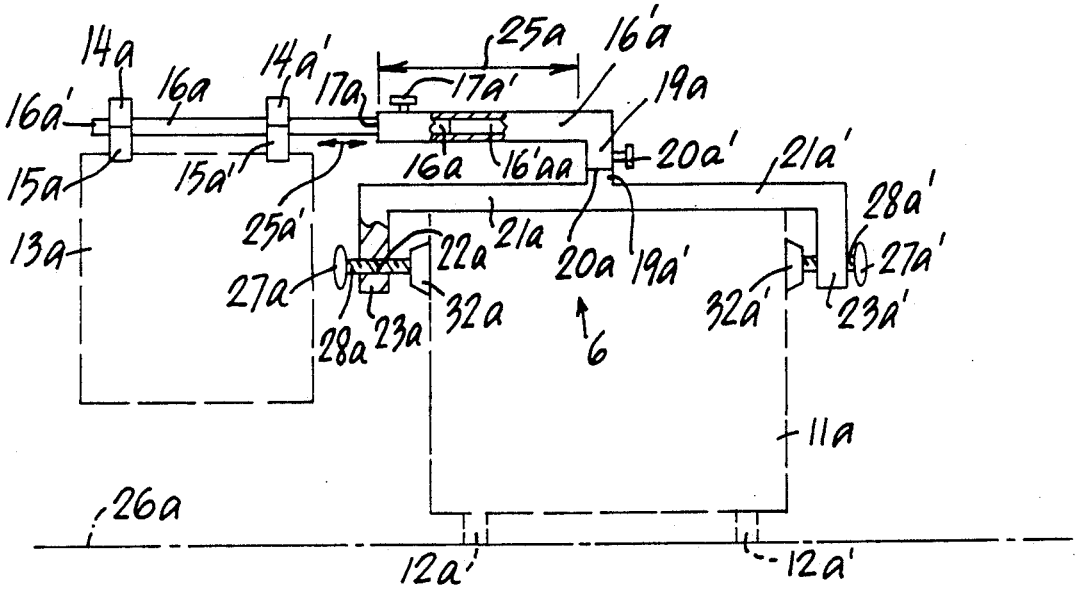

The present invention applies equally to monitors of computers and word processors, and/or other variations thereon.

With regard to the preceding Figures, variations of one illustrated embodiment as compared to other illustrated embodiments, may be included and/or substituted for alternate arrangements illustrated in one or more of the other illustrated embodiments. For example, the FIG. 5 tubular female members such as 16'e, 19e, 31e, 23e, 31e' and 23e' shown in cross-section, having locked therein the male members 16e, 19e', 21e, 21e', 23ee, 23ee' and 2eee' respectively as locked by locking screw-members 17e', 20e', 27e''', 27e, 27e' and 27e'''' respectively are preferably the same as the structures and mechanisms of FIG. 1 female member 16'a with male member 16a having locking screw-member 17a', and female member 19a with male member 19a' having lock screw-member 20a'. The same is true for the FIG. 2 female member 16'b and its male member 19b with locking screw-member 20b'. The same is true for the FIG. 3 female member 21c and its male member 21c' having lock screw-member 27c. The same is true for the FIG. 4 female member 21d and its male member 16d having lock screw member 17d' and female member 23d with its male member 23dd' having its lock screw-member 27d. Likewise, while particular hinge mechanisms are shown solely in FIG. 2 as combination hinge structure 18b with its locking pin 18b' and in FIG. 3 as combination 18c with locking pin 18c', such mechanisms and structures thereof may be also utilized in the corresponding arm-structures of other illustrated embodiments such as on the FIG. 1 arm 16a and such as the FIG. 4 arm 16d, and such as the FIG. 5 arm 16e. In like manner, it is within the scope of the invention to use the FIG. 1 clamping suction cups 32a and 32a' and the FIG. 2 clamping suction cup 32b optionally also on the corresponding FIG. 2 arms 23b and/or 24b and FIG. 3 arms 23c and 23c', and the FIG. 4 arms 24d', 23d, 23dd' and/or 24d', and FIG. 5 arms 23e and/or 23ee and/or 24e and/or 24e' and/or 31e and/or 21e and/or 21e' and/or 31e' and/or 23e' and/or 23ee'. Also, hinge structure such as that of FIG. 2 18b with locking pin 18b' may be used in sustitution for the pivot structure 20b of the female arm 16'b and male member 19b with locking screw 20b. In the FIG. 2 embodiment, while the pivot structure 20b above-noted is preferably utilized as illustrated in combination with the arm-hinge mechanism 18b with its locking screw member 18b', it is optional to omit one or the other thereof. In like manner as previously described, the pivot mechanism 20b of FIG. 2 may optionally be substituted for the hinge arrangements of FIG. 2 hinge mechanism 18b and/or the FIG. 3 hinge mechanism 18c.

While the foregoing illustrated embodiments are typical of alternate embodiments encompassing the present invention, the invention is intended to include alternate other shapes embodying the inventive concept as above-described and as within the scope of the appended claims.

Because of the similarity in structure and functional parts and elements thereof as shown in the alternative and/or preferred embodiment of the foregoing figures, related indicia are utilized for such same or corresponding parts and elements in the illustrations of the alternate typical embodiments of the foregoing figures. Once described for one embodiment, a part or element will not hereinbelow be redescribed in alternate embodiment(s), except in situations where such additional descriptions add to the clarity and understanding of the description(s).

Figure 2:
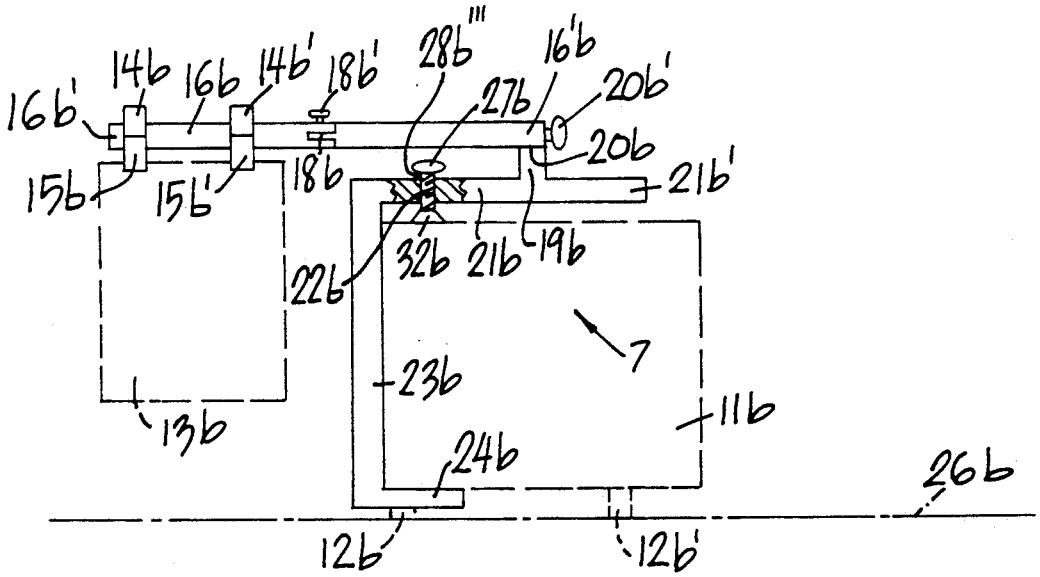

Accordingly, FIG. 1 illustrates a computer monitor drawing-exhibit sheet-mounting and adjusting device 6 for utilization when using a computer drawing-mouse or digital tablet-cusor. As an illustrated part of the device, there is a continuous integral support structure including opposite elongated horizontal structures 21a and 21a' having uprightly-extending male structure 19a' and with the respective downward-extending elongated structures 23a of structure 21a and 23a' of structure 21a'. The vise mechanism thereof arises from the screw male-threaded member 28a having handle structure 27a, screwably mounted within typical female-threads 22a of downwardly-extending elongated structure 23a. A contact structure, preferably suction cup 32a is mounted on the distal end of the male-threaded member 28a for being pressed in use against an upright side of a computer or word-processor monitor 11a. Likewise, optionally but preferably on the opposite side is found another screw male-threaded member 28a' having handle structure 27a', screwably mounted within female-threaded downwardly-extending elongated structure 23a' with the contact structure, preferably suction cup 32a' mounted on the distal end of the male-threaded member 28a' for being pressed in use against the opposite upright side of a computer or word-processor monitor 11a (shown in phantom). Thereby the vise mechanism locks onto the monitor. The pivot mechanism represents a female member 19a' mounted onto a male pivot member 19a at pivot joint 20a, intermittently lockable in any of ajustable positions by the lock screw-member 20a'. The elongated support (pivot arm) 16'a is hollow or tubular along its (typically) substantially entire length 25a (or a major proportion of its length) in the nature of the hollow structure 16'e of FIG. 5 having typically hollow space 16'aa, and is telescopeably receivable of the male suspension arm 16a which is movable in alternate directions 25a' and is telescopeable into space 16'aa within the tubular elongated member 16'a by virtue of the mating male/female-relationship and structure lockable by threaded lock-member 17a' pressable against arm 16a. It is noted that the sheet-mounting tabs or clamp handles 14a and 14a' are typically of a removable type or are adapted to slide to the distal end of the male suspension arm 16a to its distal portion 16a', thereby allowing substantially the entire arm 16'a to slide into any existing hollow space 16'aa of the tubular elongated arm 16'a. As extensions from the clamp handles 14a and 14a' respectively are the sheet-grabbing clips 15a and 15a' respectively adapted to intermittently grasp and release sheet 13a (shown in phantom) responsive to pressure applied to the clamp handles 14a and 14a' respectively. Shown in phantom on the bottom of monitor 11a are typical support legs (or equivalent ridge or other structure) 12a and 12a' (shown in phantom) by which at least typically the edges of the bottom of the monitor are elevated above a support surface 26*a* (shown in FIG. 2 diagrammatically illustrates an alternate inventive device 7 of which the pivoted elongated sheet-support structure includes the proximal pivoted elongated arm 16'*b* and distal arm 16*b*' and their hinge-joining structure 18*b* with is hinge and locking pin 18*b*'. In this embodiment, the clamp handle 27*b* and its male-threaded shaft 28*b*''' mounted in female threads 22*b* with suction cup 32*b*, are thus found in the elongated horizontal structure 21*b*. Accordingly, the clamping is achieved by the tightening of the suction cup against an upper surface of a monitor 11*b* (shown in phantom), whereby the horizontally extending lower vise-arm 24*b* is clamped against a lower surface of the monitor 11*b*.

Figure 3:
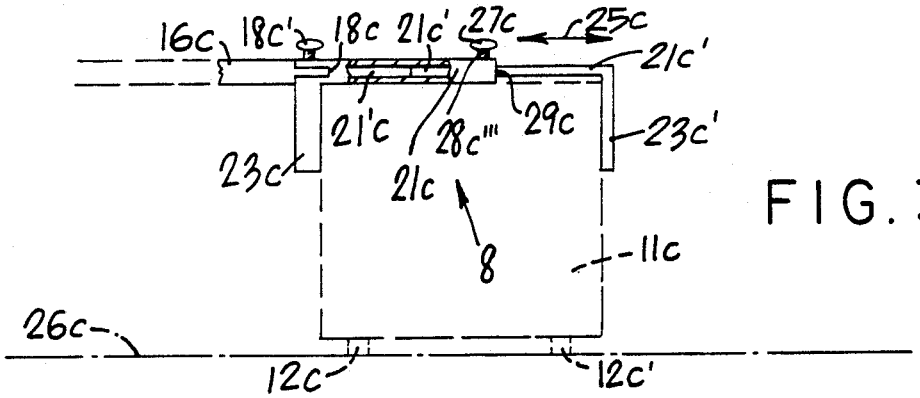

FIG. 3 diagrammatically illustrates an alternate inventive device 8 of which the pivoted elongated sheet-support structure includes the proximal pivoted elongated tubular arm 21*c* having tubular space 21'*c* with the intermittently adjustable male-member arm 21*c*' mated by the male-female relationship and structure at indicia 29*c*, with arm 21*c* having its distal end mounted within the tubular space 21'*c*. Thereby the downwarly-extending vise arm 23*c*' is adjustably clampable against an upright side of the monitor 8 (shown in phantom) in opposition to downwardly-extending vise arm 23*c*. The arm 21*c*' is intermittently alternately lockable and disengageable in optional predetermined locations by the locking handle 27*c* and its mounted male-threaded shaft 28''', in the nature of the threaded shaft 28*e*'' within female threads 29''*e* of structure 31*e*' in FIG. 5. In this FIG. 3 embodiment, the hinge structure 18*c* and its hinge and lock pin 18*c*' for the support arm 16*c*, are a part of the elongated horizontal arm 21*c* and the downwardly-extending vise arm 23.

Figure 4:
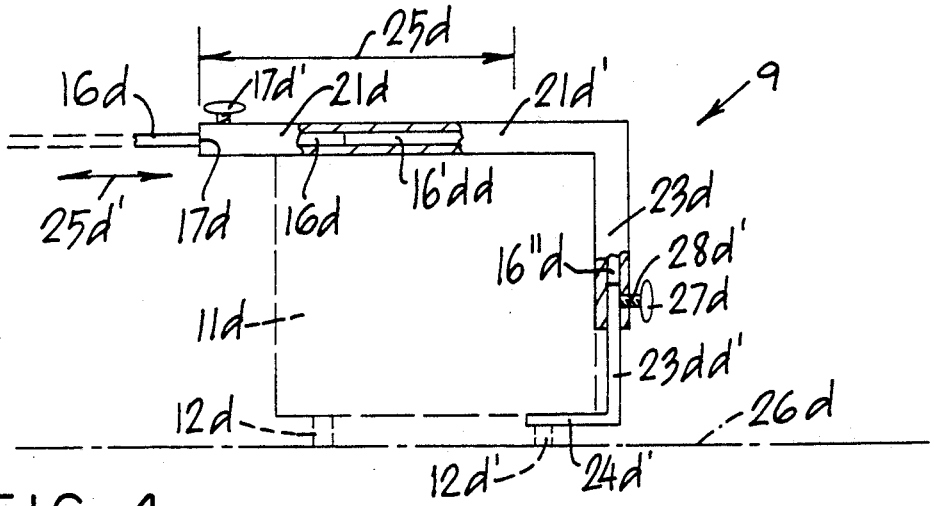

FIG. 4 diagrammatically illustrates an alternate inventive device 9 of which the elongated horizontal tubular arm 21*d* has the female-male relationship and structure 17*d* with the support arm 16*d* mounted within the tubular space 16'*dd* of horizontal tubular elongated arm 21*d*. Additionally in this embodiment, the downwardly-extending male-arm 23*dd*' mated with the tubular downwardly-extending arm 23*d* adjustably mounted within space 16''*d*, by the female-male relationship and structure 30*d*'; in optional alternate adjustable positions, the arm 23*dd*' is intermittently lockable and releasable by the handle 27*d* to adjust the male-threaded shaft in the same manner and type structure as handle 27*b* and shaft 28*b*''. Also, the downwardly-extending arm 23*d* has the horizontally extending vise-arm 24*d*' that thereby clamps onto a bottom surface of the monitor 11*d* (shown in phantom), in opposing relationship to the thereby clamped tubular structure 21*d*' that serves as an opposing vise-arm clamping downwardly onto an upper surface of the monitor 11*d*.

Figure 5:
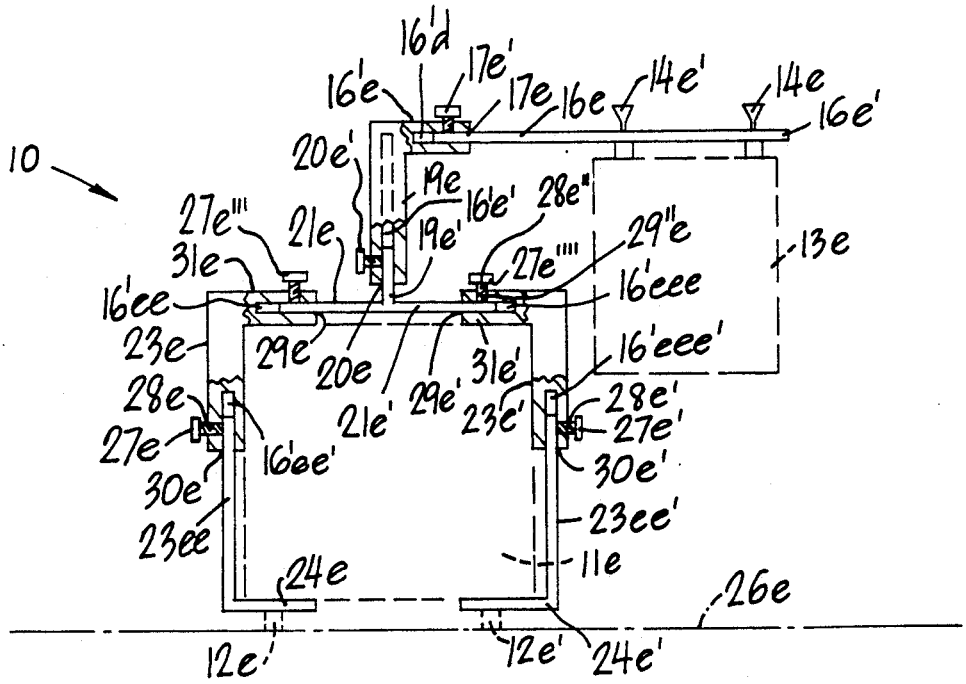
Figure 6:
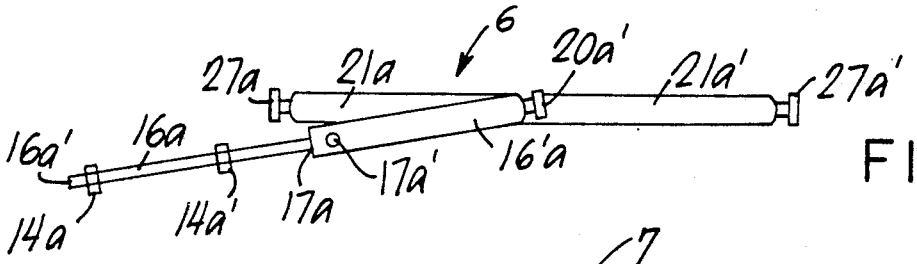
Figure 7:
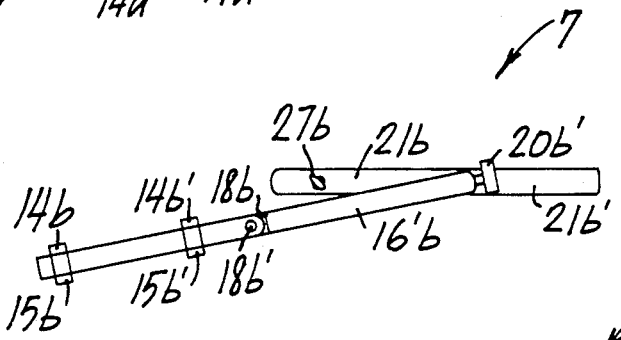
Figure 8:
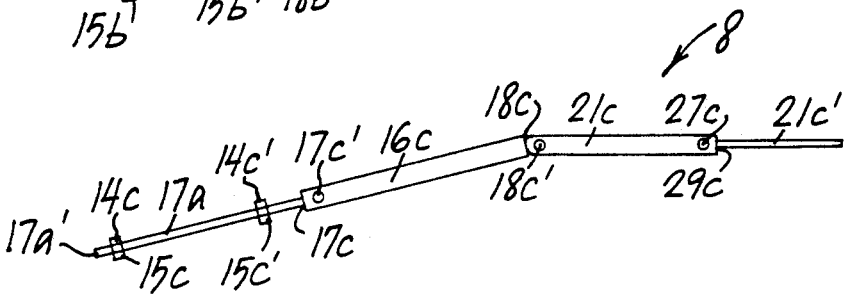
Figure 10:
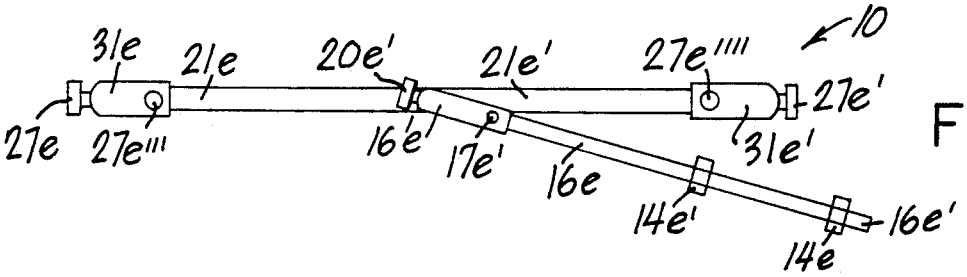
Figure 9:
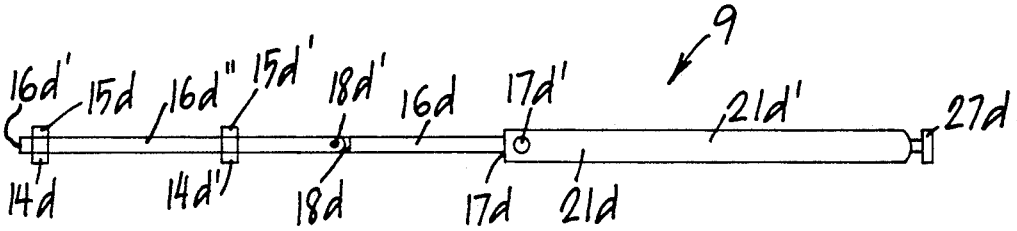

FIG. 5 diagrammatically illustrates the more preferred embodiment of this invention, in which each of the structures 16*e*, 19*e*', 21*e*, 29*e*, 29*e*', 23*ee* and 23*ee*' respectively are axially adjustable within female tubular spaces 16'*e*, 16'*e*', 16'*ee*, 16'*ee*', 16'*eee*, and 16'*eee*', at respective openings 16*e*, 20*e*, 29*e*, 30*e*, 29*e*' and 30*e*', lockable by respective threaded lock-handle-members 17*e*', 20*e*', 27*e*''', 27'''', 27*e* and 27*e*', each of which have threaded shafts such as shafts 28*e* and 28*e*' engaged like threaded shaft 28*b*''' mates with female threads 22*b* of embodiment 7 of FIG. 2. Thereby each of opposing downwardly extending arms 23*e* and 23*e*' are separately laterally adjustable by use of the handles 27*e*''' and 27*e*'''' to alter and/or set vise-pressures on the opposite upright sides of the monitor 10 (shown in phantom), and each of arms 23*ee*/24*e* and 23*ee*'/24*e*' are adjustable along an upright axis to alter and/or set vise-pressures on the top and bottom surfaces of monitor 10.

It is within the scope of the invention to make such variations and modifications and substitution of equivalents as would be obvious to a person of ordinary skill in this particular technology/art.

We claim:

1. A computer monitor drawing-exhibit sheet-mounting and adjusting device for utilization when using a computer drawing-mouse or digital tablet-cusor, comprising in combination: a drawing-exhibit support means for supporting and suspending a drawing-exhibit sheet, and an adjustable vise means for adjustably mounting on computer monitors of varying size dimensions by clamping on opposite substantially upright sides of a computer monitor, said adjustable vise means including opposingly spaced-apart vise clamp structures adapted to clamp at-least a portion of a computer monitor therebetween, said adjustable vise means including an adjusting means for adjustably mounting said drawing-exhibit support means intemittently to be positioned alternately forwardly or rearwardly along a substantially horizontal plane in alternate exhibit sheet-viewing positions, when said adjustable vise means is mounted on a computer monitor and said drawing-exhibit support means being mounted onto said adjustable vise means.

2. A computer monitor drawing-exhibit sheet-mounting and adjusting device of claim 1, in which said drawing-exhibit support means includes a substantially horizontally extending rod structure.

3. A computer monitor drawing-exhibit sheet-mounting and adjusting device of claim 2, in which said horizontally extending rod structure is axially adjustable horizontally relative to said adjusting means, when said adjustable vise means is mounted on a computer monitor.

4. A computer monitor drawing-exhibit sheet-mounting and adjusting device of claim 3, in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

5. A computer monitor drawing-exhibit sheet-mounting and adjusting device of claim 1, and including sheet downwardly suspending means for intermittently substantially downwardly suspending a drawing-exhibit sheet therefrom, when said vise means is mounted on a computer monitor.

6. A computer monitor drawing-exhibit sheet-mounting and adjusting device of claim 5, in which said drawing-exhibit support means includes a substantially horizontally extending rod structure and in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

7. A computer monitor drawing-exhibit sheet-mounting and adjusting device of claim 6, in which said adjustable vise means includes a support structure having laterally spaced-apart opposite first and second side portions thereof as said spaced-apart vise clamping structures, and said first side portions having a downwardly extending first clamping structure adapted to be pressed against a first substantially upright side of a computer monitor, and said second side portion having a downwardly extending second clamping structure adapted to be pressed against a second substantially upright side spaced from and opposite the first substantially upright side such that a computer monitor is securable between said first and second clamping structures, said adjustable vise means providing for at-least one of said first and second clamping structures to be intermittently adjustably and lockably alternately movable optionally toward and away from a remaining one of said first and second clamping structures, when said adjustable vise means is mounted on a computer monitor.

8. A computer monitor drawing-exhibit sheet-mounting and adjusting device of claim 7, in which said adjustable vise means provides for each of said first and second clamping structures to be intermittently adjustably and lockably movable alternately optionally toward and away from the other of said first and second clamping structures, when said adjustable vise means is mounted on a computer monitor.

9. A computer monitor drawing-exhibit sheet-mounting and adjusting device of claim 8, in which at least one of said first and second clamping structures includes a first upper portion and a first downwardly-extending intermittently adjustable bottom clamp having a first clamp horizontal portion thereof extending toward a remaining other one of said first and second clamping structures and said first downwardly-extending portion being adapted to be intermittently locked at optionally different levels of downward extension such that the first clamp horizontal portion is alternately movable upwardly toward and downwardly away from said upper portion such that a computer monitor is claspable between said first clamp horizontal portion and said first upper portion.

10. A computer monitor drawing-exhibit sheet-mounting and adjusting device of claim 9, in which a remaining other one of said first and second clamping structures includes a second upper portion and a second downwardly-extending intermittently adjustable bottom clamp having a second clamp horizontal portion thereof extending toward a remaining other one of said first and second clamping structures and said second downwardly-extending intermittently adjustable bottom clamp being adapted to be intermittently locked at optionally different levels of downward extension such that the second clamp horizontal portion is alternately movable upwardly toward and downwardly away from said upper portion such that a computer monitor is claspable between said second clamp horizontal portion and said second upper portion.

11. A computer monitor drawing-exhibit sheet-mounting and adjusting device of claim 9, in which said horizontally extending rod structure is axially adjustable horizontally relative to said adjusting means, when said adjustable vise means is mounted on a computer monitor.

12. A computer monitor drawing-exhibit sheet-mounting and adjusting device for utilization when using a computer drawing-mouse or digital tablet-cusor, comprising in combination: a drawing-exhibit support means for supporting and suspending a drawing-exhibit sheet, and an adjustable vise means for adjustably mounting on computer monitors of varying size dimensions by clamping on opposite substantially upright sides of a computer monitor, said adjustable vise means including opposingly spaced-apart vise clamp structures adapted to clamp at-least a portion of a computer monitor therebetween, said adjustable vise means including a support structure having laterally spaced-apart opposite first and second side portions thereof as said spaced-apart vise clamping structures, and said first side portions having a downwardly extending first clamping structure adapted to be pressed against a first substantially upright side of a computer monitor, and said second side portion having a downwardly extending second clamping structure adapted to be pressed against a second substantially upright side spaced from and opposite the first substantially upright side such that a computer monitor is securable between said first and second clamping structures, said adjustable vise means providing for one of said first and second clamping structures to be intermittently adjustably and lockably alternately movable optionally toward and away from a remaining one of said first and second clamping structures, when said adjustable vise means is mounted on a computer monitor, said adjustable vise means providing for a remaining one of said first and second clamping structures to be intermittently adjustably and lockably movable alternately optionally toward and away from said one of said first and second clamping structures when said adjustable vise means is mounted on a computer monitor, and said drawing-exhibit support means being mounted onto said adjustable vise means, at least one of said first and second clamping structures including a first upper portion and a first downwardly-extending intermittently adjustable bottom clamp having a first clamp horizontal portion thereof extending toward a remaining other one of said first and second clamping structures and said first downwardly-extending portion being adapted to be intermittently locked at optionally different levels of downward extension such that the first clamp horizontal portion is alternately movable upwardly toward and downwardly away from said upper portion such that a computer monitor is claspable between said first clamp horizontal portion and said first upper portion.

13. A computer drawing-exhibit sheet-mounting and adjusting device of claim 12, in which a remaining other one of said first and second clamping structures includes a second upper portion and a second downwardly-extending intermittently adjustable bottom clamp having a second clamp horizontal portion thereof extending toward a remaining other one of said first and second clamping structures and said second downwardly-extending intermittently adjustable bottom clamp being adapted to be intermittently locked at optionally different levels of downward extension such that the second clamp horizontal portion is alternately movable upwardly toward and downwardly away from said upper portion such that a computer monitor is claspable between said second clamp horizontal portion and said second upper portion.

14. A computer monitor drawing-exhibit sheet-mounting and adjusting device of claim 12, in which said drawing-exhibit support means includes a substantially horizontally extending rod structure and in which said horizontally extending rod structure is axially adjustable horizontally relative to said adjusting means, when said adjustable vise means is mounted on a computer monitor.

15. A computer monitor drawing-exhibit sheet-mounting and adjusting device for utilization when using a computer drawing-mouse or digital tablet-cusor, comprising in combination: a drawing-exhibit support means for supporting and suspending a drawing-exhibit sheet, and an adjustable vise means for adjustably mounting on computer monitors of varying size dimensions by clamping on opposite substantially upright sides of a computer monitor, said adjustable vise means including opposingly spaced-apart vise clamp structures adapted to clamp at-least a portion of a computer monitor therebetween, said adjustable vise means including a support structure having laterally spaced-apart opposite first and second side portions thereof as said spaced-apart vise clamping structures, and said first side portions having a downwardly extending first clamping structure adapted to be pressed against a first substantially upright side of a computer monitor, and said second side portion having a downwardly extending second clamping structure adapted to be pressed against a second substantially upright side spaced from and opposite the first substantially upright side such that a computer monitor is securable between said first and second clamping structures, said adjustable vise means providing for one of said first and second clamping structures to be intermittently adjustably and lockably alternately movable optionally toward and away from a remaining one of said first and second clamping structures, when said adjustable vise means is mounted on a computer monitor, said drawing-exhibit support means being mounted onto said adjustable vise means, at-least one of said first and second clamping structures including a first adjustably screwable clamp screwably alternately advanceable to press against a first upright side of a computer monitor to secure the adjustable vise means onto a computer monitor and retractable laterally away from an upright side of a computer monitor to release said adjustable vise means for a mounting thereof on a computer monitor, when said adjustable vise means is mounted on a computer monitor, a remaining one of said first and second clamping structures including a first adjustably screwable clamp screwably alternately advanceable to press against another upright side opposite from the first upright side of a computer monitor to secure the adjustable vise means onto a computer monitor and retractable laterally away from an upright side of a computer monitor to release said adjustable vise means for a mounting thereof on a computer monitor, when said adjustable vise means is mounted on a computer monitor, said support structure including first and second upper portions postioned substantially along a horizontal plane when the adjustable clamping means is mounted on a computer monitor, and said adjustable clamping means including a securable means for intermittently securably mounting one of said first and second upper portions to a remaining other one of said first and second upper portions, such that when the first and second upper portions are mounted one on the other, a first one of the first and second upper portions is positioned above one of substantially first and second upright side walls of a computer monitor and a remaining other second one of the first and second upper portion is positioned above another second substantially upright side wall spaced-apart from and opposite the one, when the adjustable clamping means is mounted on a computer monitor.

16. A computer monitor drawing-exhibit sheet-mounting and adjusting device of claim 15, in which one of said first and second upper portions includes a female mating portion and in which a remaining other one of said first and second upper portions includes a male mating portion detachably mountable within said female mating portion.

17. A computer monitor drawing-exhibit sheet-mounting and adjusting device of claim 16, in which said first upper portion and said second upper portion extend axially in opposite directions between said first substantially upright wall and said second substantially upright wall, when the adjustable clamping means is mounted on a computer monitor.

18. A computer monitor drawing-exhibit sheet-mounting and adjusting device of claim 17, in which said adjustable vise means includes an adjusting means for adjustably mounting said drawing-exhibit support means intemittently to be positioned alternately forwardly or rearwardly along a substantially horizontal plane in alternate exhibit sheet-viewing positions, when said adjustable vise means is mounted on a computer monitor.

19. A computer monitor drawing-exhibit sheet-mounting and adjusting device of claim 18, in which said drawing-exhibit support means includes a substantially horizontally extending rod structure.

20. A computer monitor drawing-exhibit sheet-mounting and adjusting device of claim 19, in which said horizontally extending rod structure is axially adjustable horizontally relative to said adjusting means, when said adjustable vise means is mounted on a computer monitor.

21. A computer monitor drawing-exhibit sheet-mounting and adjusting device of claim 20, in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

22. A computer monitor drawing-exhibit sheet-mounting and adjusting device of claim 18, and including sheet downwardly suspending means for intermittently substantially downwardly suspending a drawing-exhibit sheet therefrom, when said vise means is mounted on a computer monitor.

23. A computer monitor drawing-exhibit sheet-mounting and adjusting device of claim 22, in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

24. A computer monitor drawing-exhibit sheet-mounting and adjusting device of claim 23, in which said adjustable vise means includes a support structure having laterally spaced-apart opposite first and second side portions thereof, and said first side portions having a downwardly extending first clamping structure adapted to be pressed against a first substantially upright side of a computer monitor, and said second side portion having a downwardly extending second clamping structure adapted to be pressed against a second substantially upright side spaced from and opposite the first substantially upright side such that a computer monitor is securable between said first and second clamping structures, said adjustable vise means providing for at-least one of said first and second clamping structures to be intermittently adjustably and lockably alternately movable optionally toward and away from a remaining one of said first and second clamping structures, when said adjustable vise means is mounted on a computer monitor.

25. A computer monitor drawing-exhibit sheet-mounting and adjusting device of claim 24, in which said adjustable vise means provides for each of said first and second clamping structures to be intermittently adjustably and lockably movable alternately optionally toward and away from the other of said first and second clamping structures, when said adjustable vise means is mounted on a computer monitor.

26. A computer monitor drawing-exhibit sheet-mounting and adjusting device of claim 25, in which at least one of said first and second clamping structures includes a first upper portion and a first downwardly-extending intermittently adjustable bottom clamp having a first clamp horizontal portion thereof extending toward a remaining other one of said first and second clamping structures and said first downwardly-extending portion being adapted to be intermittently locked at optionally different levels of downward extension such that the first clamp horizontal portion is alternately movable upwardly toward and downwardly away from said upper portion such that a computer monitor is claspable between said first clamp horizontal portion and said first upper portion.

27. A computer monitor drawing-exhibit sheet-mounting and adjusting device of claim 26, in which a remaining other one of said first and second clamping structures includes a second upper portion and a second downwardly-extending intermittently adjustable bottom clamp having a second clamp horizontal portion thereof extending toward a remaining other one of said first and second clamping structures and said second downwardly-extending intermittently adjustable bottom clamp being adapted to be intermittently locked at optionally different levels of downward extension such that the second clamp horizontal portion is alternately movable upwardly toward and downwardly away from said upper portion such that a computer monitor is claspable between said second clamp horizontal portion and said second upper portion.

28. A computer monitor drawing-exhibit sheet-mounting and adjusting device of claim 26, in which said horizontally extending rod structure is axially adjustable horizontally relative to said adjusting means, when said adjustable vise means is mounted on a computer monitor.

29. A computer monitor drawing-exhibit sheet-mounting and adjusting device for utilization when using a computer drawing-mouse or digital tablet-cusor, comprising in combination: a drawing-exhibit support means for supporting and suspending a drawing-exhibit sheet, and an adjustable vise means for adjustably mounting on computer monitors of varying size dimensions by clamping on opposite substantially upright sides of a computer monitor, said adjustable vise means including opposingly spaced-apart vise clamp structures adapted to clamp at-least a portion of a computer monitor therebetween, said adjustable vise means including a support structure having laterally spaced-apart opposite first and second side portions thereof as said spaced-apart vise clamping structures, and said first side portions having a downwardly extending first clamping structure adapted to be pressed against a first substantially upright side of a computer monitor, and said second side portion having a downwardly extending second clamping structure adapted to be pressed against a second substantially upright side spaced from and opposite the first substantially upright side such that a computer monitor is securable between said first and second clamping structures, said adjustable vise means providing for one of said first and secopnd clamping structures to be intermittently adjustably and lockably alternately movable optionally toward and away from a remaining one of said first and second clamping structures, when said adjustable vise means is mounted on a computer monitor, said drawing-exhibit support means being mounted onto said adjustable vise means, at-least one of said first and second clamping structures including a first adjustably screwable clamp screwably alternately advanceable to press against a first upright side of a computer monitor to secure the adjustable vise means onto a computer monitor and retractable laterally away from an upright side of a computer monitor to release said adjustable vise means for a mounting thereof on a computer monitor, when said adjustable vise means is mounted on a computer monitor, a remaining one of said first and second clamping structures including a first adjustably screwable clamp screwably alternately advanceable to press against another upright side opposite from the first upright side of a computer monitor to secure the adjustable vise means onto a computer monitor and retractable laterally away from an upright side of a computer monitor to release said adjustable vise means for a mounting thereof on a computer monitor, when said adjustable vise means is mounted on a computer monitor, said support structure including first and second upper portions and an intermediate portion between the first and second upper portions postioned substantially along a horizontal plane when the adjustable clamping means is mounted on a computer monitor, the intermediate portion having spaced-apart opposite first and second intermediate portion ends, and in which said adjustable clamping means includes first and second securable means for intermittently securably mounting one of said first and second upper portions to one of said first and second intermediate portion ends and for intermittently securably mounting a remaining other one of said first and second upper portions to a remaining other one of said first and second upper portions, such that when the first and second upper portions are mounted on said first and second intermediate portion ends, a first one of the first and second upper portions is positioned above one of a substantially first upright side wall of a computer monitor and a remaining other second one of the first and second upper portion is positioned above another second substantially upright side wall spaced-apart from and opposite the one, when the adjustable clamping means is mounted on a computer monitor.

30. A computer monitor drawing-exhibit sheet-mounting and adjusting device of claim 29, in which said adjustable vise means includes an adjusting means for adjustably mounting said drawing-exhibit support means intemittently to be positioned alternately forwardly or rearwardly along a substantially horizontal plane in alternate exhibit sheet-viewing positions, when said adjustable vise means is mounted on a computer monitor.

31. A computer monitor drawing-exhibit sheet-mounting and adjusting device of claim 30, in which said drawing-exhibit support means includes a substantially horizontally extending rod structure.

32. A computer monitor drawing-exhibit sheet-mounting and adjusting device of claim 30, and including sheet downwardly suspending means for intermittently substantially downwardly suspending a drawing-exhibit sheet therefrom, when said vise means is mounted on a computer monitor.

33. A computer monitor drawing-exhibit sheet-mounting and adjusting device of claim 31, in which said horizontally extending rod structure is axially adjustable horizontally relative to said adjusting means, when said adjustable vise means is mounted on a computer monitor.

34. A computer monitor drawing-exhibit sheet-mounting and adjusting device of claim 33, in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

35. A computer monitor drawing-exhibit sheet-mounting and adjusting device of claim 32, in which one of said drawing exhibit support means and said adjustable vise means pivotally mounts a remaining other one of said drawing exhibit support means and said adjustable vise means at a predetermined pivot location such that said horizontally extending rod structure is pivotably laterally adjustable around said predetermined pivot location, when said adjustable vise means is mounted on a computer monitor.

* * * * *